US005874879A

United States Patent [19]

Taka et al.

[11] Patent Number: 5,874,879

[45] Date of Patent: Feb. 23, 1999

[54] LEAKAGE FLUX CANCELING DEVICE

[75] Inventors: Yoshio Taka, Kanagawa; Tomomi Inoue, Fukushima, both of Japan

[73] Assignee: Sony Corporation, Japan

[21] Appl. No.: 683,216

[22] Filed: Jul. 18, 1996

[51] Int. Cl.[6] ..... H01F 5/02; H01J 29/06

[52] U.S. Cl. ..... 335/214; 315/8; 315/85; 348/819

[58] Field of Search ..... 335/210–214; 313/440; 315/8, 85; 348/819, 820

[56] References Cited

U.S. PATENT DOCUMENTS

| | | | |
|---|---|---|---|
| 5,036,246 | 7/1991 | Germani | 313/440 |
| 5,220,241 | 6/1993 | Kanazawa et al. | 313/440 |
| 5,355,107 | 10/1994 | Hwang et al. | 335/214 |
| 5,448,212 | 9/1995 | Ohtsu et al. | 335/214 |

FOREIGN PATENT DOCUMENTS

| | | | |
|---|---|---|---|
| 193048 | 8/1987 | Japan | 313/440 |
| 72044 | 4/1988 | Japan | 313/440 |
| 225046 | 9/1989 | Japan | 313/440 |
| 297037 | 12/1991 | Japan | 313/440 |
| 190115 | 7/1993 | Japan | 313/440 |

*Primary Examiner*—Lincoln Donovan
*Assistant Examiner*—Raymond Barrera
*Attorney, Agent, or Firm*—Ronald P. Kananen

[57] ABSTRACT

A leakage flux canceling device is provided which requires a small number of parts and which has high space factor. A leakage flux canceling device 30 is mounted to a funnel side of a deflecting apparatus for reducing leakage flux to a panel side attributable to a horizontal deflection magnetic field, and comprises a ring-like body 32 having flanges 32 facing each other, a pair of bobbins 40 and 60 without cores formed on the flanges, a canceling coil 34 wound on each of the bobbins for canceling leakage flux, and winding grooves 48 and 68 formed in the respective bobbins such that the winding of each canceling coil has a greater length in the circumferential direction, and permitting the canceling coils to be wound from the outer surface side of the corresponding bobbins. The bobbins and the ring-like body are formed as a one-piece body, and the bobbins each have an arcuate shape matching the ring-like body.

17 Claims, 7 Drawing Sheets

LEAKAGE FLUX CANCELING DEVICE

BACKGROUND OF THE INVENTION

1. Field of the Invention

This invention relates to a leakage flux canceling device suitable for use with a cathode-ray tube used in television receiving sets or monitors for various OA equipment.

2. Description of the Related Art

A cathode-ray tube (CRT) used in a television receiving set or a monitor for OA equipment is provided with a canceling device for canceling the leakage flux attributable to a horizontal deflection magnetic field, in order that the horizontal deflection magnetic field leaking out to the front face of the panel may not exceed a prescribed level. FIG. 7 shows an example of a conventional device.

As shown in the figure, a deflecting apparatus 10 has a bell-shaped coil bobbin 12 produced by plastic molding, and horizontal coils (i.e., horizontal deflection coils) 16 are fitted in respective grooves (not shown) formed at predetermined locations on the inner surface of the bell-shaped coil bobbin 12.

The horizontal coils 16 to be used may each be obtained by winding wire with the use of a coil winder (not shown) so that the winding may have a predetermined coil distribution, and then pressing the winding. FIG. 7 exemplifies such coils, wherein the pressed horizontal coils 16 are securely attached to respective predetermined positions of the aforementioned bell-shaped coil bobbin 12.

A ferrite core 13, which is in the form of a truncated cone, is fitted on the outer surface of the bell-shaped coil bobbin 12, and vertical deflection coils (not shown) are fitted around the ferrite core 13. A neck insertion cylinder 17 is formed on one side of the bell-shaped coil bobbin 12 corresponding in position to the neck of a CRT, and a box-shaped cover 20 is attached to the outer surface of the neck insertion cylinder 17. The cover 20 is provided for covering an adjusting ring for a quadrupole magnet, terminals of various lead wires necessary for the deflecting apparatus, and so forth.

A leakage flux canceling device 30 mentioned above is arranged at a front bend (funnel side) of the bell-shaped coil bobbin 12. In the illustrated example, canceling coils 34, which form part of a ring-like body 32, are arranged at substantially symmetrical locations. For the canceling coils 34, automatically wound coils are used.

The ring-like body 32 is attached to the front bend side of the bell-shaped coil bobbin 12 in such a manner that the canceling coils 34 are directed toward the rear bend (neck side). The mounting positions and energization polarities of the pair of canceling coils 34 are selected so that the magnetic flux produced by energization of the canceling coils 34 can cancel the magnetic flux leaking out toward the front face of the panel due to the aforementioned horizontal deflection magnetic field. By providing the canceling device 30, it is possible to greatly reduce the leakage flux to the front face of the panel.

The canceling device 30 described above generally has a structure shown in FIGS. 8 and 9. As shown in the figures, the ring-like body 32 has a groove perpendicular to its circumferential direction (in practice, defined by a pair of flanges 39*a* and 39*b*), and guide pieces 36 for mounting canceling coils are formed across portions of the groove at locations almost opposite each other. To obtain the canceling coils 34 as illustrated, wire is wound into square-shape by using a coil winder (not shown) and then the winding is pressed.

The pressed canceling coils 34 are each inserted between a corresponding pair of guide pieces 36 and a U-shaped cover 38 is fitted over each coil 34, whereby the canceling device 30 as shown in FIG. 7 is obtained.

Thus, conventionally the canceling coils 34 are individually formed using a coil winder and capped with the cover 38, and this entails drawbacks such as an increased number of parts, decreased productivity and high cost.

These drawbacks may be eliminated by employing the structure shown in FIG. 10. In the illustrated example, a ring-like body 32 and bobbins 40 and 60 are formed as a one-piece body, and canceling coils 34 are wound on respective flanges formed on the bobbins 40 and 60. With this arrangement, the number of parts is reduced and no covers are required, whereby the decreased productivity is improved and the cost can be cut down.

In the case where the bobbins 40 and 60 are formed integrally with the ring-like body as shown in FIG. 10, however, since the bobbins are each in the form of a rectangular parallelepiped, the space factor is low, and also the bobbins can be caught on an object and damaged during or after the coil winding or during transportation.

OBJECT AND SUMMARY OF THE INVENTION

This invention was created to solve the problems associated with the conventional arrangement, and an object thereof is to provide a leakage flux canceling device which has high space factor and is free of damage.

To achieve the above object, there is provided according to the invention of claim 1 a leakage flux canceling device which is mounted to a funnel side of a deflecting apparatus for reducing leakage flux to a panel side attributable to a horizontal deflection magnetic field, and which comprises a ring-like body having flanges facing each other, a pair of bobbins formed on the flanges, a canceling coil wound on each of the bobbins for canceling leakage flux and a winding groove formed in each of the bobbins such that a winding of the canceling coil has a greater length in a circumferential direction, and permitting the canceling coil to be wound from an outer surface side of the corresponding bobbin.

As shown in FIG. 1, bobbins 40 and 60 without cores, are formed integrally with a ring-like body 32 as a one-piece member and their cross sections are each in the form of an arc having the same radius as the ring-like body 32. This arrangement makes it possible to reduce the number of parts of the device and to improve the space factor.

The bobbins 40 and 60 have flanges 46 and 66, respectively, which protrude radially from the peripheral surface (radially outside surface) of the ring-like body 32 so that canceling coils 34 can be wound from outside of the body, whereby winding of the canceling coils 34 is greatly facilitated. This shape and structure permit automatic winding by means of a coil winder.

The wind-start end and terminal end of the individual coils can be retained by clipping means 50 and 70, whereby the coils never collapse and can keep their shape.

Other objects, features and advantages of the present invention will become apparent in the following specification and accompanying drawings.

DESCRIPTION OF THE PREFERRED EMBODIMENT

A leakage flux canceling device according to one embodiment of this invention will be hereinafter described in detail with reference to the drawings, wherein the device is applied to a deflecting apparatus for a CRT mentioned above.

Figure 1:
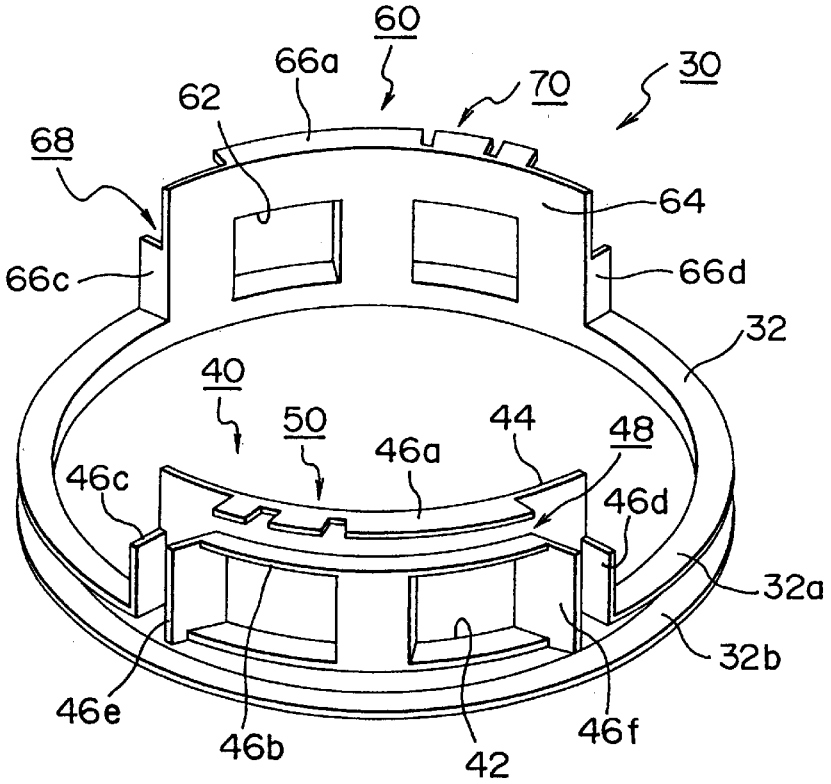
FIG. 1 is a perspective view showing an example of a leakage flux canceling device according to this invention.
Figure 7:
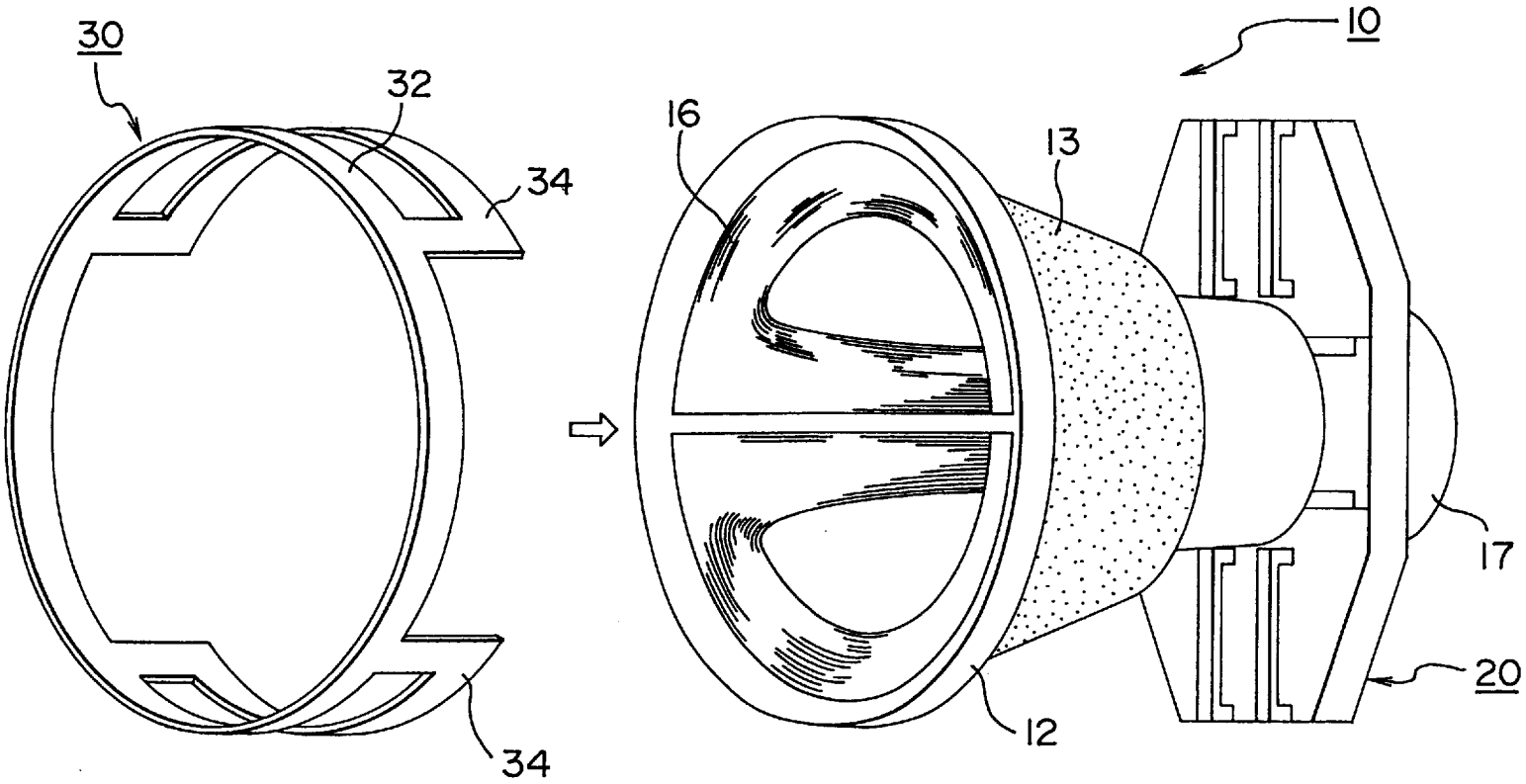
FIG. 7 is a perspective view showing the relationship between a deflecting apparatus and a canceling device.
Figure 8:
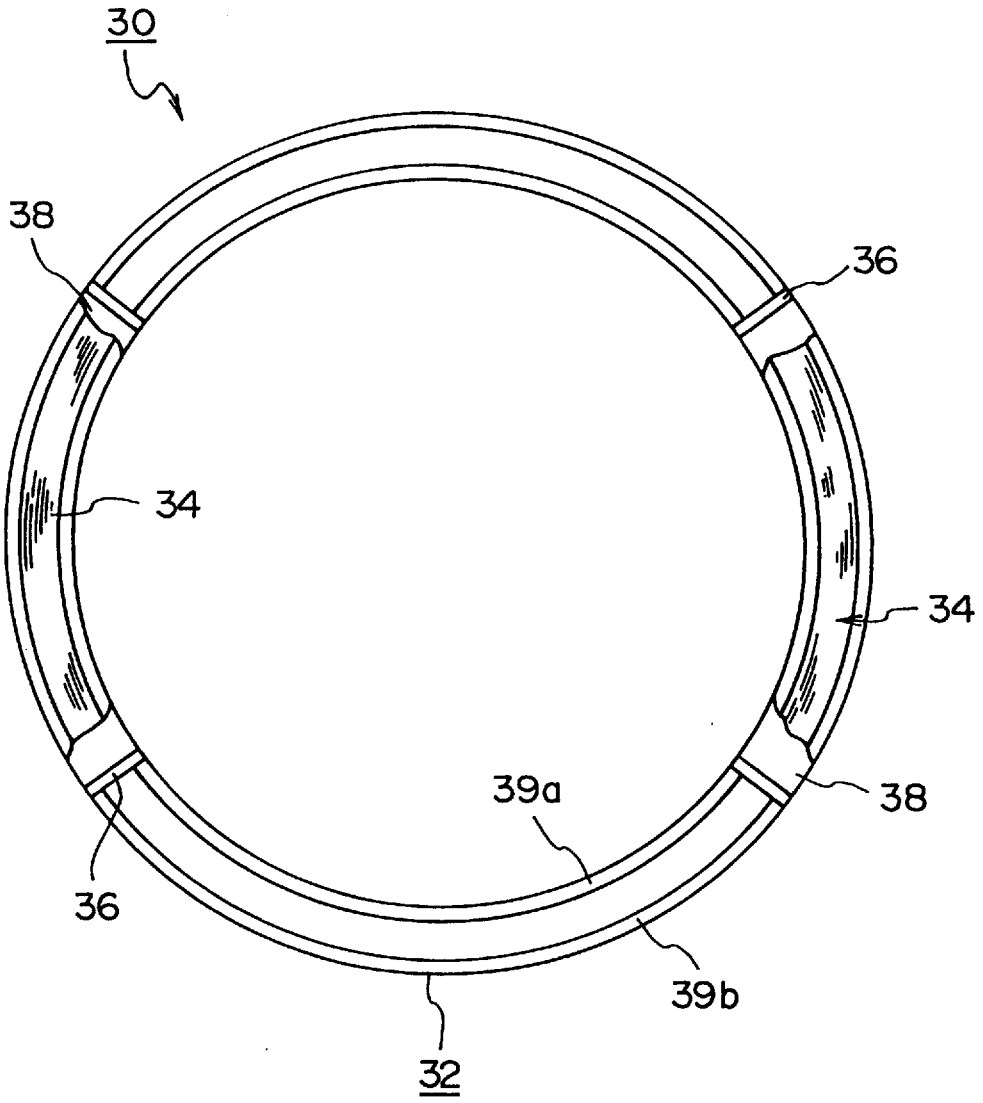
FIG. 8 is a plan view of the canceling device.
Figure 9:
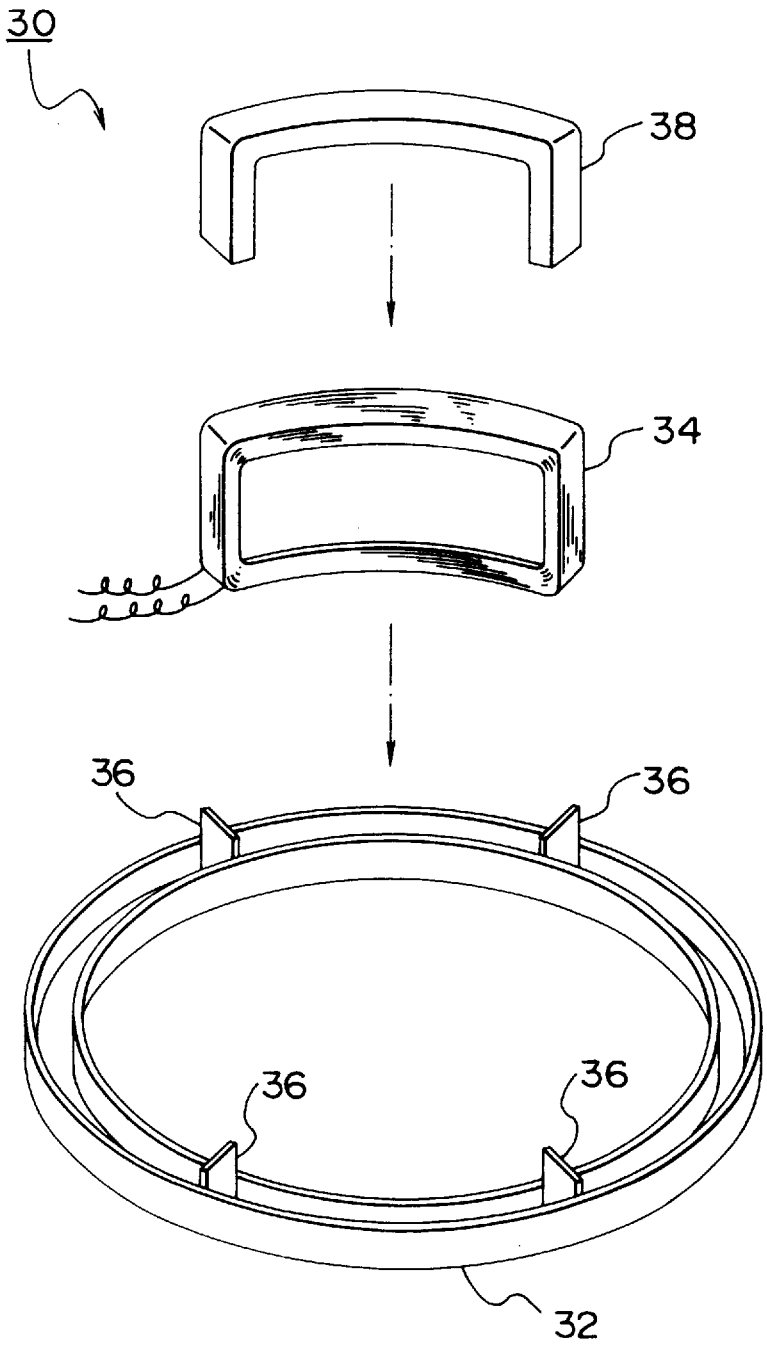
FIG. 9 is an exploded perspective view of the canceling device.
Figure 10:
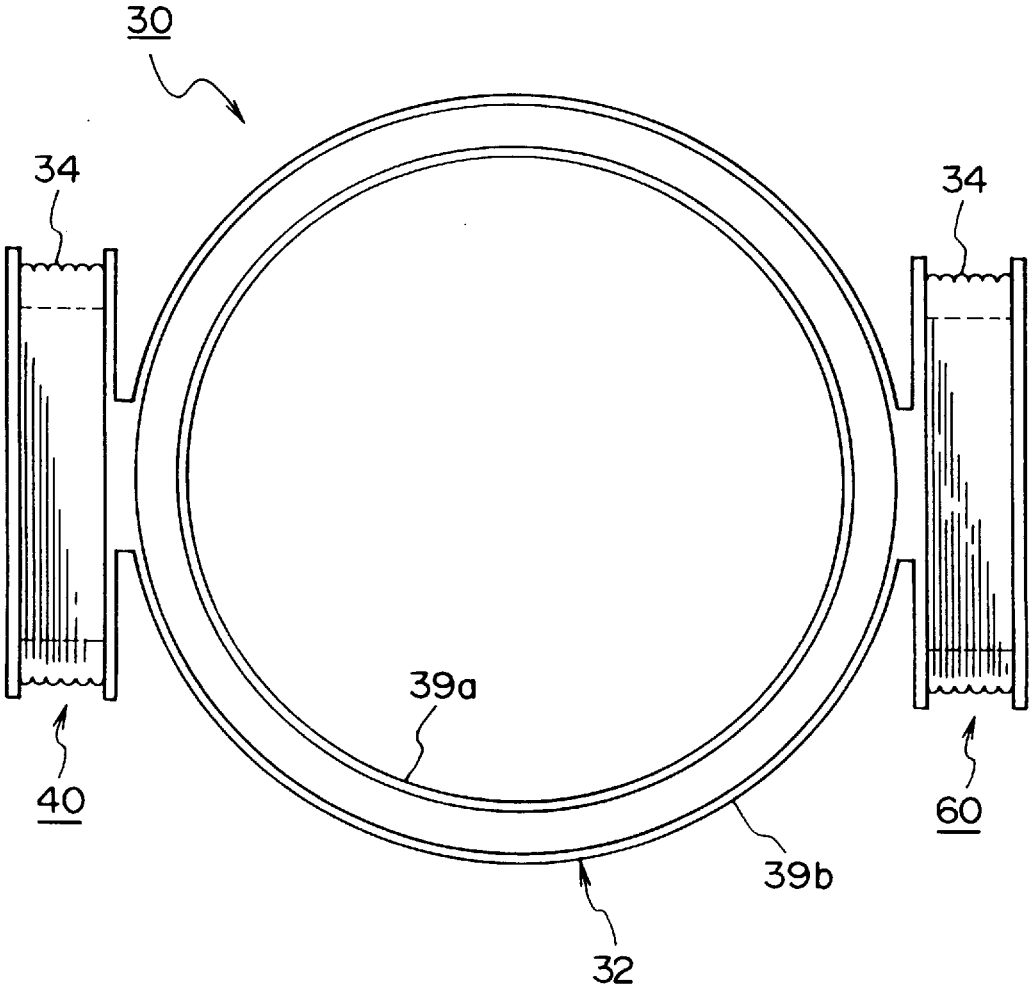
FIG. 10 is a plan view showing another example of a canceling device, for illustrating this invention.

FIG. 1 illustrates a specific example of a leakage flux canceling device 30 according to this invention, which comprises a ring-like body 32 whose inner diameter is suitably set so that the body can be fitted on the front bend (funnel side) of the bell-shaped coil bobbin 12 shown in FIG. 7. The ring-like body 32, which is a plastic molded product, has a pair of radially protruding flanges 32*a* (upper) and 32*b* (lower) as illustrated, so that a correction coil can be wound inside the flanges into ring form.

A pair of bobbins 40 and 60 without cores are formed integrally with the ring-like body 32 as a one-piece member so as to face each other. A specific example of the bobbins 40 and 60 will be explained with reference to FIGS. 1 through 6. The bobbins 40 and 60 are each laterally elongated and have inner walls 44 and 64, respectively, which are contiguous with the bottom of the ring-like body 32 and extend in the axial direction of the tube. The arcuate length of each bobbin in the circumferential direction is set so as to extend over an angular range of about 90 degrees (the angle is given by way of example), and a pair of right and left windows 42 and 62 are cut in the central portions of the respective bobbins so that the bobbins may each be constructed without cores as a whole.

Figure 5:
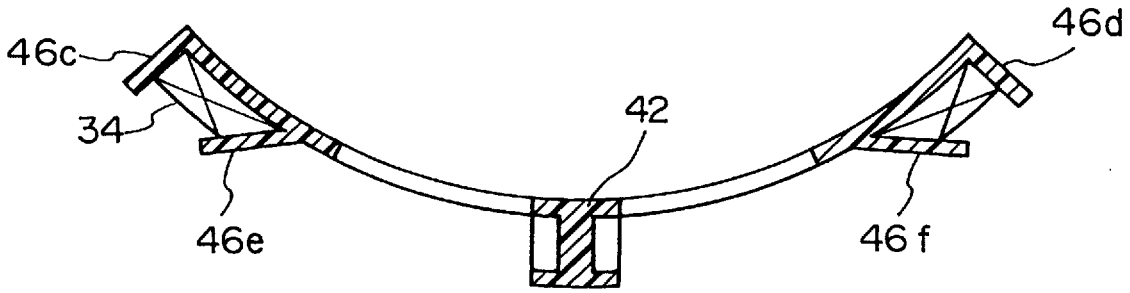
FIG. 5 is a sectional view taken along line 5—5 in FIG. 2.
Figure 6:
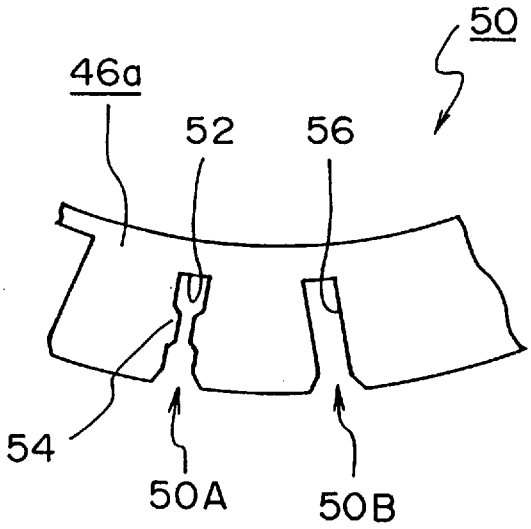
FIG. 6 is a plan view showing an example of clipping means.

The inner walls 44 and 64 and the aforementioned flanges 32*a* and 32*b* define winding grooves 48 and 68 along which canceling coils 34 are to be wound. As shown in the figures, upper flanges 46*a* and 66*a* are formed on the outsides of the inner walls 44 and 64, respectively, and inner flanges 46*b* and 66*b* (not shown) are formed at a predetermined distance from the respective upper flanges and face the corresponding upper flanges. Left and right side flanges 46*c* and 46*d* (66*c* and 66*d*) protrude radially from the respective sides of the inner wall 44 (64), and inner flanges 46*e* and 46*f* (66*e* and 66*f*, not shown), which are inclined outward as shown in FIG. 5, are formed between the side flanges.

Figure 2:
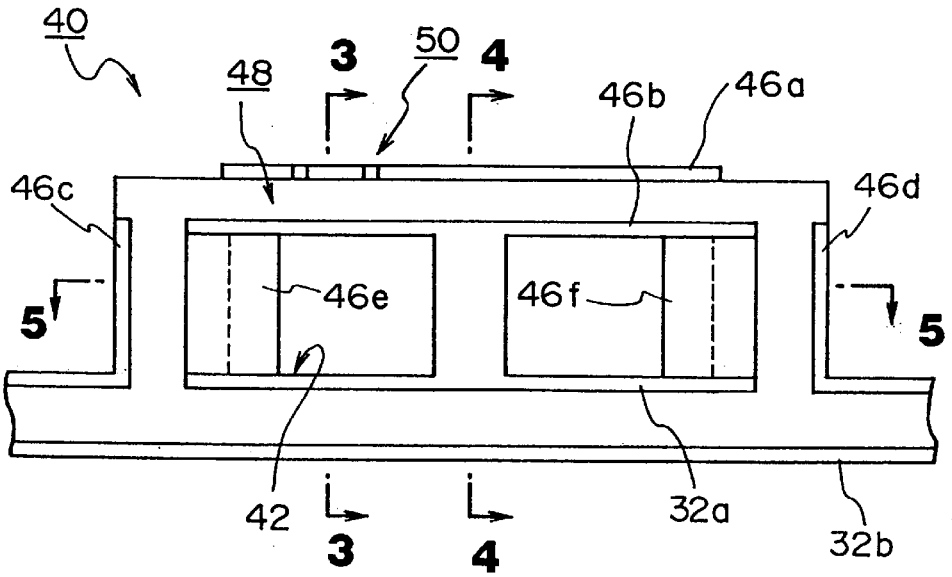
FIG. 2 is a plan view of a bobbin forming part of the device.
Figure 3:
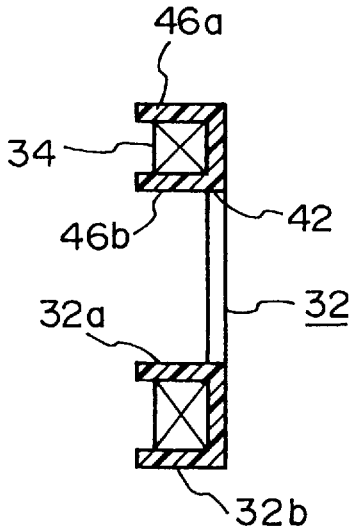
FIG. 3 is a sectional view taken along line 3—3 in FIG. 2.
Figure 4:
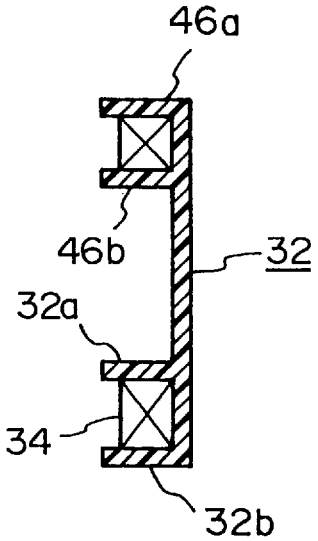
FIG. 4 is a sectional view taken along line 4—4 in FIG. 2.

The flanges 32*a* and 32*b* of the ring-like body 32 serve as lower flanges. The flanges 46 and 66, which are constituted by the corresponding ones of the upper flanges, right and left side flanges and lower flanges, define the respective winding grooves 48 and 68 each having a predetermined width and a predetermined depth, as shown in FIG. 2.

The canceling coil 34 is wound along each of the winding grooves 48 and 68 for a predetermined number of turns. This coil winding is carried out from the side of the outer surface of the ring-like body 32 by using a coil winder. In order that the coils may not slip off from the winding grooves 48 and 68 during the winding by means of the coil winder, the inner flanges 46*e* and 46*f*, in particular, are inclined outward as shown in FIG. 5, because the coils can often slip off from the inner flanges.

As shown in FIG. 1, clipping means 50 and 70 are formed in the respective upper flanges 46*a* and 66*a* of the bobbins 40 and 60, in order to prevent the canceling coils 34 from collapsing during the winding. The clipping means 50 and 70 have an identical structure, and therefore, the clipping means 50 alone will be described with reference to a specific example shown in FIG. 6.

The clipping means 50 comprises a wind-start clip 50A and a wind-end clip 50B adjacent to the clip 50A. The clip 50A is a slit 52 opening at one end, as shown in the figure, and bulges 54 are formed at an intermediate portion of the clip so as to prevent the coil from slipping of f from the clip. The clip 50A serves to retain the wind-start end of the coil whereas the clip 50B serves to retain the other end, or the terminal end, of the coil, thereby preventing the coil from collapsing after the winding.

The wind-end clip 50B is a slit 56 merely opening at one end, but may be provided with bulges as mentioned above. The illustrated example has no bulges formed thereon because the coil end is usually wound on a terminal plate (not shown) after the winding and thus the coil does not collapse if the clip 50B has no bulges.

The width depth, etc. of the slits 52 and 56 are suitably set in accordance with the diameter of the canceling coil used and other factors.

Thus, in the leakage flux canceling device 30 according to this invention, a pair of bobbins 40 and 60 are formed integrally with the ring-like body 32 as a one-piece member, the winding grooves 48 and 68 are formed in the respective bobbins 40 and 60 to extend in directions such that the canceling coils 34 can be wound from the side of the outer surfaces of the respective bobbins, and also means are provided for preventing the canceling coils 34 from collapsing. With this arrangement, the number of parts of the canceling device itself can be reduced, as compared with conventional devices, and the canceling coils 34 can be automatically wound onto the ring-like body 32 by directly using a coil winder. During the automatic winding, the coils do not collapse since the flanges protrude in suitable directions and also due to the clipping means 50 and 70.

As described above, according to this invention, the bobbins on which the canceling coils are wound are formed integrally with the ring-like body and each have an arcuate shape matching the ring-like body.

Consequently, the number of component parts of the canceling device for canceling leakage flux is reduced, whereby providing increased productivity and the cost can be cut down. Also, since the bobbins have an arcuate shape matching the ring-like body, the space factor is high, and in cases where the bobbins without cores are provided with clipping means, the canceling coils can be reliably prevented from collapsing. The bobbins are arcuate in shape, and accordingly, they are not damaged during assembling work or during transportation of parts.

Coils can be wound on the bobbins from outside, whereby winding of the canceling coils onto the bobbins can be automated, thus permitting the winding work for the canceling device to be shortened correspondingly. Therefore, the canceling device according to this invention is especially suitable for use with deflecting apparatus used in television receiving sets or monitors of various OA equipment.

As many apparently different embodiments of this invention may be made without departing from the spirit and scope thereof, it is to be understood that the invention is not limited to the specific embodiments thereof except as defined in the appended claims.

What is claimed is:

1. A leakage flux canceling device for mounting to a funnel side of a deflecting apparatus, comprising:

an annular body having a lower and an upper flange which face each other, said flanges each having a thickness and a width, said width extending in a radial direction with respect to said annular body;

a pair of bobbins formed on the annular body, wherein said bobbins are formed above said lower flange and each has an arcuate shape matching said annular body;

a canceling coil wound on each of said bobbins for canceling leakage flux; and a winding groove formed in each of said bobbins by said upper and lower flanges and additional bobbin flanges formed on the corresponding bobbin.

2. The leakage flux canceling device according to claim 1, wherein said bobbins are formed integrally with said annular body as a one-piece member.

3. The leakage flux canceling device according to claim 1, wherein one of the bobbin flanges defining said winding groove of each said bobbin includes clipping means for retaining an end of the corresponding canceling coil.

4. The leakage flux canceling device according to claim 1, wherein said lower flange extends around the entire circumference of said annular body.

5. The leakage flux canceling device according to claim 1, wherein said upper flange extends around the entire circumference of said annular body except where said winding groove passes to or from one of said bobbins.

6. A leakage flux canceling device for mounting to a funnel side of a deflecting apparatus, comprising:

an annular body having a plurality of flanges;

a plurality of bobbins formed with the annular body and comprising winding grooves defined by said flanges and additional bobbin flanges formed on said bobbins, said winding grooves containing canceling coils;

wherein at least one axially extending flange of at least one of said bobbins which is inside said canceling coil is acutely or obtusely angled with respect to said bobbin so as to retain said canceling coil.

7. A leakage flux canceling device as set forth in claim 6, wherein said bobbins are curved with a curvature matching said annular body.

8. A leakage flux canceling device as set forth in claim 7, wherein an arcuate length of each bobbin in a circumferential direction extends over an angular range of 90°.

9. A leakage flux canceling device as set forth in claim 6, wherein said bobbins include right and left windows cut in central portions of the respective bobbins so that the bobbins may each be built without cores.

10. A leakage flux canceling device as set forth in claim 6, wherein said bobbins comprise inner walls which extend along a radial direction with respect to said annular body and, with said flanges and said bobbin flanges, define said winding grooves along which said canceling coils are located, said bobbin flanges being formed on said inner walls.

11. A leakage flux canceling device as set forth in claim 10, wherein said bobbin flanges comprise an inner flange formed at a predetermined distance from an upper flange and facing the upper flange.

12. A leakage flux canceling device as set forth in claim 11, further including clipping means formed in the upper flanges of the bobbins in order to prevent the canceling coils from collapsing during winding.

13. A leakage flux canceling device as set forth in claim 11, wherein said clipping means includes a wind-start clip and a wind-end clip adjacent to the wind-start clip respectively formed in the respective upper flanges of the bobbins.

14. A leakage flux canceling device as set forth in claim 12, wherein said wind-start clip and said wind-end clip each include a slit opening at one end.

15. A leakage flux canceling device as set forth in claim 6, further including clipping means to retain the wind-start end of the coil and the terminal end of the coil, thus to prevent the coil from collapsing after winding.

16. A leakage flux canceling device as set forth in claim 6, wherein one of said flanges on said annular body extends around the entire circumference of said annular body.

17. A leakage flux canceling device as set forth in claim 6, wherein one of said flanges on said annular body extends around the entire circumference of said annular body except where said winding groove passes to or from one of said bobbins.

* * * * *